US007866712B2

(12) United States Patent
Kintz

(10) Patent No.: US 7,866,712 B2
(45) Date of Patent: Jan. 11, 2011

(54) FREE EGRESS WINDOW

(75) Inventor: James D. Kintz, Gillette, WY (US)

(73) Assignee: Tumble Weed Products, LLC, Gillette, WY (US)

( * ) Notice: Subject to any disclaimer, the term of this patent is extended or adjusted under 35 U.S.C. 154(b) by 868 days.

(21) Appl. No.: 11/768,362

(22) Filed: Jun. 26, 2007

(65) Prior Publication Data

US 2008/0296916 A1 Dec. 4, 2008

Related U.S. Application Data

(63) Continuation-in-part of application No. 11/755,266, filed on May 30, 2007, now abandoned.

(51) Int. Cl.
*E05C 19/10* (2006.01)

(52) U.S. Cl. ..... 292/121; 292/277

(58) Field of Classification Search ..... 292/257, 292/277, 109, 97, 341.17, 203, 210, 121, 292/122, 102, 108, 219, 227, DIG. 65, DIG. 71, 292/DIG. 20, DIG. 37; 49/503, 506
See application file for complete search history.

(56) References Cited

U.S. PATENT DOCUMENTS

| | | | | | |
|---|---|---|---|---|---|
| 1,158,533 | A | * | 11/1915 | Moore | 292/71 |
| 1,664,576 | A | * | 4/1928 | Stuart et al. | 292/127 |
| 1,937,978 | A | * | 12/1933 | Miller | 292/127 |
| 2,138,251 | A | * | 11/1938 | Lindstrom et al. | 292/198 |
| 2,872,233 | A | * | 2/1959 | Bordner, Jr. | 292/92 |
| 3,151,901 | A | * | 10/1964 | Aldgren | 292/124 |
| 3,936,086 | A | * | 2/1976 | Berkowitz | 292/341.17 |
| 4,208,837 | A | * | 6/1980 | Black et al. | 49/56 |
| 4,489,807 | A | * | 12/1984 | Rodriquez | 182/96 |
| 5,056,262 | A | | 10/1991 | Schweiss et al. | |
| 5,098,139 | A | * | 3/1992 | Larsson | 292/97 |
| 5,119,591 | A | | 6/1992 | Sterner, Jr. et al. | |
| 5,997,053 | A | * | 12/1999 | Marquez | 292/153 |
| 6,327,879 | B1 | * | 12/2001 | Malsom | 70/97 |

FOREIGN PATENT DOCUMENTS

| | | |
|---|---|---|
| EP | 0329315 A1 | 8/1989 |
| EP | 0507592 B1 | 10/1992 |
| EP | 0647756 B1 | 4/1995 |
| EP | 0808974 A3 | 11/1997 |
| GB | 2176837 A | 1/1987 |

* cited by examiner

*Primary Examiner*—Carlos Lugo
*Assistant Examiner*—Kristina R Fulton
(74) *Attorney, Agent, or Firm*—Dorr, Carson & Birney, P.C.

(57) ABSTRACT

A fast operating, free egress latch system is provided with a cam having three distinct surfaces. One of these surfaces has a concave inner cam region for receiving a window latch pin. Another of these surfaces serves to prevent inadvertent relocking of a window, skylight, door, etc. once it has been opened.

9 Claims, 9 Drawing Sheets

SECTION A-A

SECTION B-B

FREE EGRESS WINDOW

RELATED APPLICATIONS

This application is a continuation-in-part of U.S. patent application Ser. No. 11/755,266 filed May 30, 2007.

BACKGROUND OF THE INVENTION

1. Field of the Invention

This invention generally relates to window latches. More specifically, it is concerned with window latches that can be quickly operated to open a window to allow fast, free egress through said window, especially in an emergency situation such as a fire. Windows that employ such latches will normally be located in the walls of a room. Such windows could, however, also be located in building roofs and thereby serving as skylights for lofts, attics and the like.

2. Discussion of the Background

Windows for emergency exit use are well known. For example, European Patent Application No. 0 329 315 A1 discloses a pivotally mounted window that, upon actuation of a control handle, releases a catch in order to disengage the lower ends of arms located in the vertical components of a window sash. Forces applied by gas driven springs then act upon the arms in such a manner that said arms move outwardly about a hinged axis in an upper horizontal component of the window sash and thereby forcing the window sash outward and clear of the window frame to create an emergency exit.

U.S. Pat. No. 5,056,262 discloses a window guard screen and frame assembly installed on the jamb of a building window in a manner that prevents unauthorized external access, but permits quick egress from within the building through the window in case of an emergency such as a fire. A screen can be fabricated from a metal sheet whose margins are folded inward to define channel-like ends and side branches bordering a planar field. The frame is dimensioned to overlie and nest within the window jamb to which the window is secured. Integral with the inner surface of the frame and bordering the opening therein is a slideway socket for receiving a screen. The socket is defined by end and side legs which complement the branches of the screen. Hinge pins are mounted on the end legs of the slideway socket adjacent to one of the side legs. These pins extend through elongated slots formed in corresponding end branches of the screen. The screen is slidable to an extent that is limited by the slots from a security mode position in which the screen is confined to the socket. The egress mode screen is free to swing on the hinge pins out from the frame opening and thereby permitting exit through the window. A releasable latch is mounted on the opposing side leg of the socket to engage a corresponding side branch of the screen to lock the socketed screen in its locked, security mode position. When released, the latch permits the screen, which is spring loaded, to slide to its fast egress permitting mode.

These prior art fast egress systems have latch systems that are activated by small levers located on the window sash. Such levers may be difficult to find and actuate using only the strength of human fingers, especially under emergency conditions. Moreover, many prior art latch systems may be subject to being inadvertently relocked under the human stress normally attendant to dealing with an emergency situation.

SUMMARY OF THE INVENTION

The present invention provides a free egress window latch system that is especially designed for fast egress from a room, especially under emergency conditions such as a fire. Applicant's free egress latch system also serves to prevent inadvertent relocking of the window from the outside. The free egress latch system of this patent disclosure can be mounted in a room wall adjacent to a hinged window having a latch pin that protrudes from an adjacent vertical component of a window sash so that the latch pin can cooperate with the free egress latch system in a manner hereinafter more fully described.

The latch system of this patent disclosure has a housing component that can be rectangular, square, etc. as far as its exterior shape is concerned. In any case, the housing component contains a latch pin receiving mechanism that includes a latch cam that, upon actuation, becomes capable of a rocking motion that serves to release the window latch pin from the grip of the latch cam. The latch cam is provided with three distinct camming surfaces whose respective functions are hereinafter more fully described. The housing component further comprises a tubular sleeve component that houses a push rod whose first end is mechanically connected to the latch pin cam. The opposing end of the push rod terminates in an actuator such as a push knob that protrudes from a room wall adjacent to the window served by Applicant's free egress latch system.

In an emergency situation such as a fire, a human being can push an actuator (such as a push knob) inwardly (i.e., toward the outside wall of the building) with the palm of his/her hand. This pushing action is naturally aided by the weight of that person's body. The resulting pushing action is therefore inherently more powerful than a twisting and/or pulling action by human fingers. The actuator (e.g., push knob) can be brightly colored (red, orange, yellow, etc.) for ease of identification in an emergency situation. Pushing on the window to be opened and the actuator (push knob) at the same time will further facilitate a fast opening of the window. Thus, the occupants of the room in which the actuator is located can quickly exit the room through the now opened window.

Next, it should be noted that the housing is also provided with a slot that allows passage of a latch pin into/out of the interior region of said housing. An opposing end of the housing is provided with a hole that allows passage of a push rod into/out of the interior region of the housing. A latch cam, capable of clockwise/counterclockwise motion about an axle upon which said latch cam is rotatably mounted, is positioned in the housing in a manner such that it can mechanically cooperate with the latch pin. This latch cam is further provided with (i) a first hole through which the axle passes, (ii) a top camming surface for pressing against a cam pressure plate, (iii) a concave inner cam region for receiving the latch pin, (iv) a latch pin blocking surface that prevents the latch pin from returning to the concave inner cam and (v) a second hole in which a push rod end is mounted.

An axle mounted in the interior of the housing has a diameter smaller than the diameter of the first hole in the latch cam through which the axle passes and thereby allowing clockwise/counterclockwise motion of the latch cam about the axle. A cam receiver plate that is biased against the top camming surface of the latch cam by a biasing device such as a spring. A tubular sleeve is affixed to the housing. This tubular sleeve contains a push rod whose inner end is connected to the second hole in the latch cam and whose outer end is connected to a push knob located in a room next to the window being served by this free egress system. A push knob is adapted and arranged to receive pressure from a human hand in order to force the push rod toward the housing and thereby rotate the latch cam about the axle and release the latch pin from the concave inner cam region of the latch cam.

This free egress latch system is also particularly characterized by the fact that once the latch pin has been released from the grip of the latch pin cam, the latch pin can not inadvertently return to the latch pin receiving region of the latch cam and thereby relocking the window shut and thus preventing re-entry into the room through the window by rescue personnel. In order to deliberately re-engage the latch pin of the window with the latch pin cam of the free egress latch system, the push knob must be pushed inwardly from within the room. Normally this would be done after the emergency condition was over and the return of normal conditions would call for the window to be relocked.

DETAILED DESCRIPTION OF THE INVENTION

Figure 1:
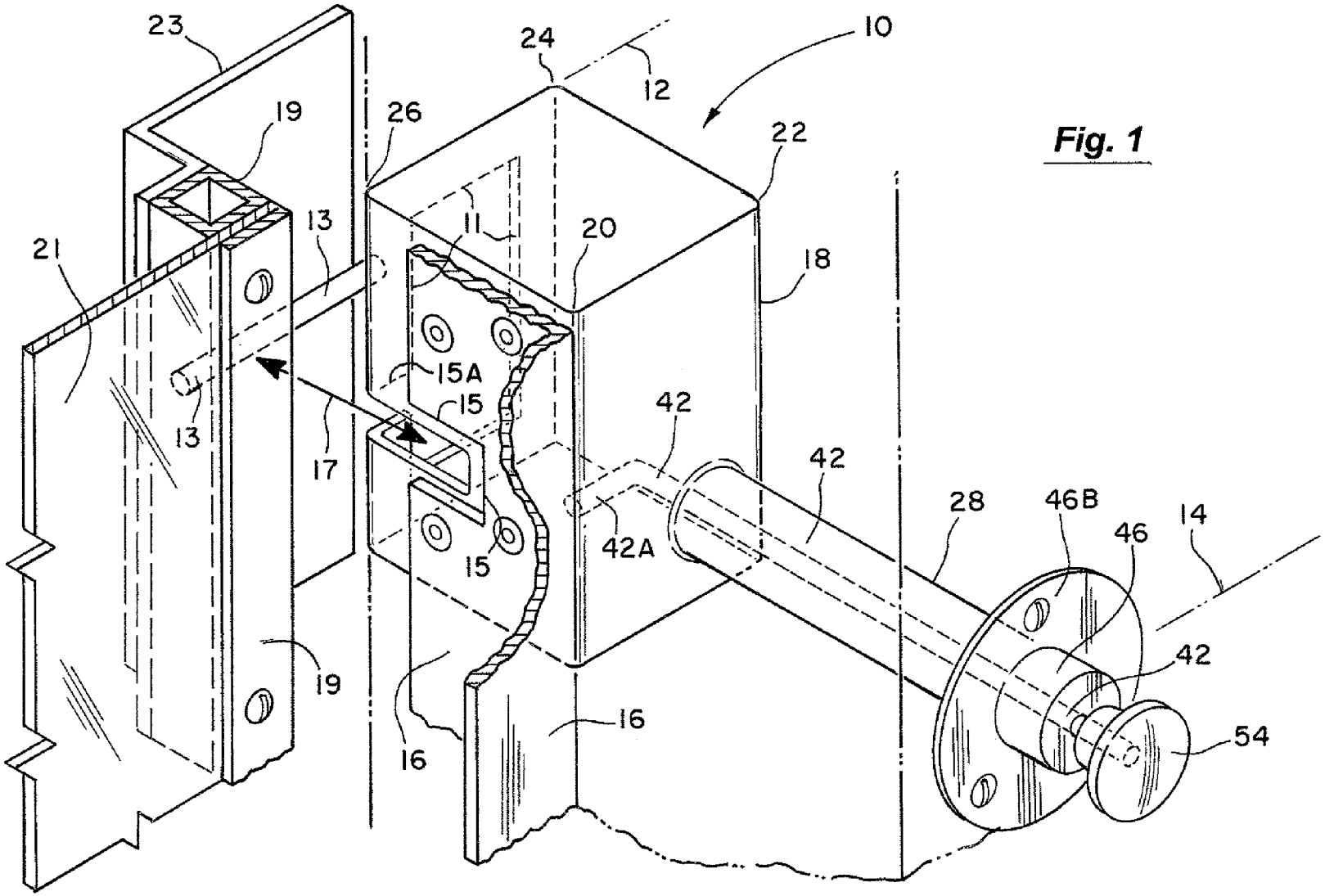
FIG. 1 is a perspective view of the free egress latch of this patent disclosure shown positioned next to a vertical element of a window sash having a latch pin with which the free egress latch cooperates.

FIG. 1 is a perspective view of various outer features of a free egress latch system constructed, adapted and arranged according to the teachings of this patent disclosure. The inner features of said system will be illustrated in subsequent FIGS. 3-8. This latch system 10 is mounted between an outside wall 12 and an inside wall 14 of a building not otherwise shown. The mounting of this latch system 10 could, for example, be achieved through use of a mounting bracket such as the L-shaped mounting bracket 16 depicted in FIG. 1. As previously noted this latch system 10 could also service a skylight type window in a building roof or a door. However, a wall mounted system used in conjunction with a window will be used as an illustrative example throughout this patent disclosure.

The latch system 10 of FIG. 1 is shown provided with a rectangular housing component 18 whose top four corners are respectively indicated by the numbers 20, 22, 24 and 26. Again, this housing component 18 could have other shapes (e.g., square, ellipsoidal, etc.), but a rectangular shape will be used for purposes of illustration. The latch system 10 also has a tubular sleeve component 28. This tubular sleeve component 28 is depicted as having a round cross-section, but it could just as well have a square, rectangular, etc. cross section. The tubular sleeve component 28 is securely affixed to the 20-22 side of the rectangular housing component 18 (e.g., by being welded, threaded, etc. thereto). The tubular sleeve component 28 houses a push rod 42 that is affixed to a human hand-operated actuator such as a push knob 54.

The 24-26 side of the rectangular housing component also can have an opening that facilitates free passage of a window latch pin 13 into and out of the interior of the housing component 18 wherein various moving components of a latch mechanism, hereinafter more fully described, are located. The 20-26 side of the rectangular housing 18 contains a slot 15 that allows passage of the window latch pin 13 into and out of (as suggested by two-headed arrow 17) the interior of the rectangular housing component 18. The 24-26 side of the housing also contains a perpendicular extension of the slot 15 in the 20-26 side of the housing 18. This perpendicular extension is designated as item 15A. The window latch pin 13 is mounted in a vertical element of a window sash 19. Such a window sash 19 could, for example, contain a mesh screen, a glass pane, etc. An anti-tampering plate is also shown attached to the vertical element of the window sash 19.

Figure 2:
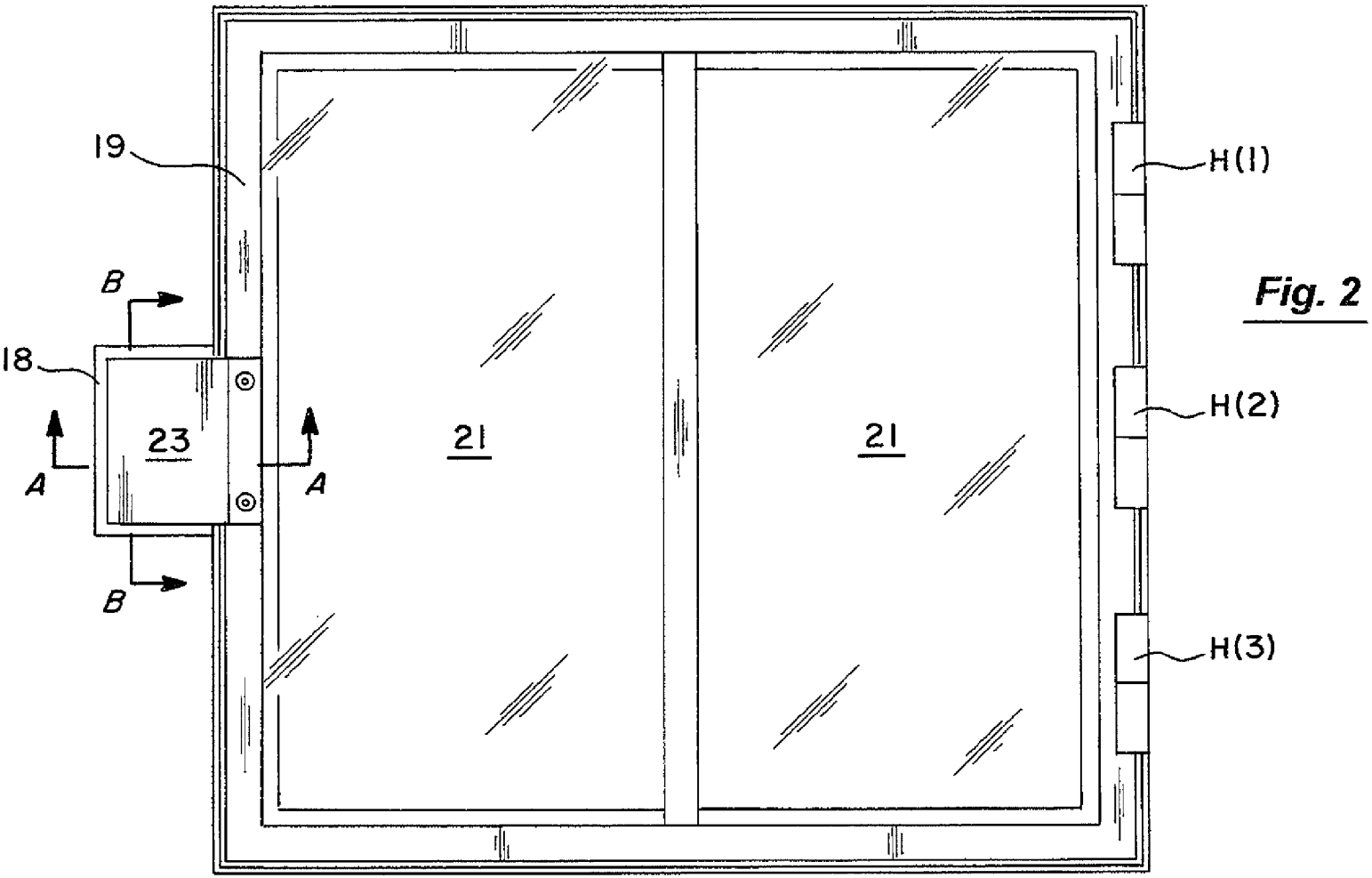
FIG. 2 is a front view of a window that is served by Applicants free egress latch system.
Figure 3:
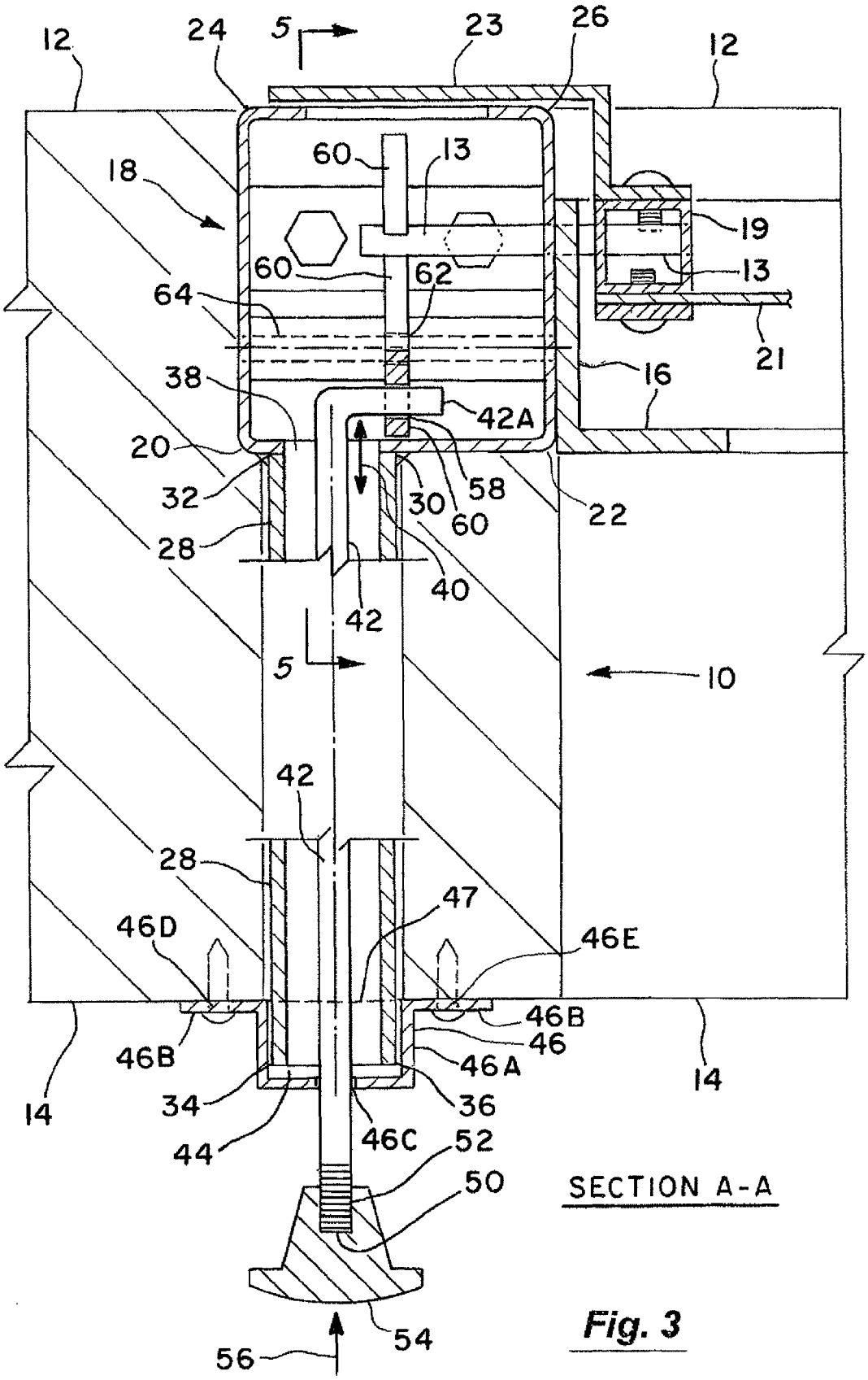
FIG. 3 is a cross sectional view of the free egress latch and a window that cooperates with said latch.
Figure 5:
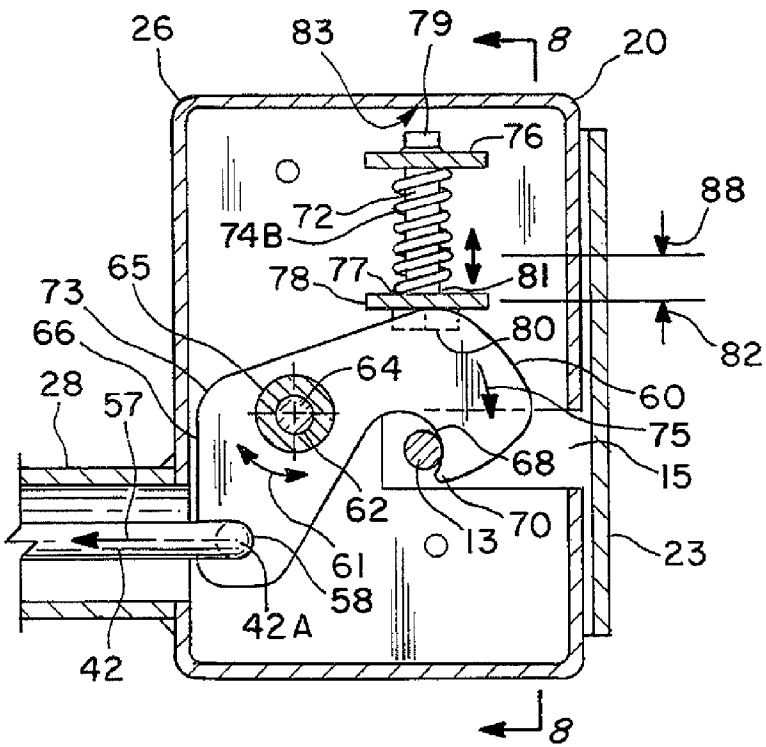
FIG. 5 is a cross sectional view of the free egress latch engaged with the latch pin of the window sash.

FIG. 2 is an elevation view of a hinged window (containing a pane of glass, mesh cover, screen, etc.) whose hinged end is, for example, shown provided with three window hinges H(1), H(2) and H(3). The unhinged end of the window sash is provided with the latch system of this patent disclosure. A cross sectional view indicated by cross section lines A-A is depicted in FIG. 3. Cross sectional view B-B is depicted in FIG. 5.

FIG. 3 is the A-A cross sectional view of the free egress latch system 10 illustrated in FIG. 1. Again, this latch system 10 is mounted between an outside wall 12 and an inside wall 14 of a building not otherwise shown. As noted in the discussion of FIG. 1, the mounting of the latch system 10 to a building may, for example, be achieved through use of a mounting bracket such as the L-shaped mounting bracket 16 depicted in FIG. 1. Here again, the latch system of FIG. 3 is depicted with a rectangular housing component whose four corners in this view are respectively indicated by the numbers 20, 22, 24 and 26. The latch system 10 also has a tubular sleeve component 28 whose, by way of example, cross sectional corners are indicated by the numbers 30, 32, 34 and 36. The tubular sleeve component 28 is firmly affixed to the 20-22 side of the rectangular housing component 18 (e.g., by being welded, threaded, etc. thereto). The 20-22 side of the rectangular housing component 18 is also provided with a hole 38 that allows free reciprocal motion (depicted by two-headed arrow 40) of the push rod 42 that generally resides inside of the tubular sleeve component 28. The indoor end 44 of the tubular sleeve component 28 and the push rod 42 are shown protruding out of a hole 47 in the inside wall 14. The end of the push rod is shown covered by a push knob 54. The tubular sleeve 28 and push rod 42 may be cut to the desired length in the field to suit the thickness of the wall in which this free egress latch system is mounted. The indoor end 44 of the tubular sleeve component 28 also, for esthetic reasons, can be covered by an escutcheon 46. Such an escutcheon 46 may have the general configuration of a cup portion 46A surrounded by a rim portion 46B. The bottom of the cup portion of the escutcheon 46 is shown provided with a hole 46C through which the push rod 42 can freely pass. The rim portion 46B of the escutcheon 46 may be provided with holes 46D and 46E that will pass screws or other fasteners that can attach the rim 46B of the escutcheon 46 to the face of the inside wall 14.

The inside end of the push rod 42 is shown provided with an attachment mechanism for attaching the inside end 50 of the push rod 42 to a push knob 54. To this end the inside end 50 of the push rod 42 is shown provided with threads 52. When an outwardly directed force 56 (e.g., such as a force applied by a human hand) is placed upon the push knob 54, the push rod 42 is forced outwardly (i.e., toward outside wall 12). The opposite end of the push rod 42 has an L-shaped end 42A that passes through a hole 58 in a pivotally mounted latch cam 60. The pivotally mounted latch cam 60 has a second hole 62 through which an axle 64 passes. The axle 64 has a diameter smaller than the hole 62 in the latch cam 60 through which the axle 64 passes. This circumstance allows the cam 60 to freely rotate about the axle 64 and thereby allow a clockwise/counterclockwise or "rocking" motion of the latch cam 60 about the axle 64 when a force 56 is applied to—and released from—the push knob 54. As better seen in FIG. 8, a first end of the axle 64 is anchored (e.g., by welding, threading, etc.) to the 20-24 side of the rectangular housing component 18. The opposite end of the axle 64 is similarly affixed to the 22-26 side of the rectangular housing component 18. It also should be noted that section lines 5-5 of FIG. 3 show the view depicted in FIG. 5.

Figure 4:
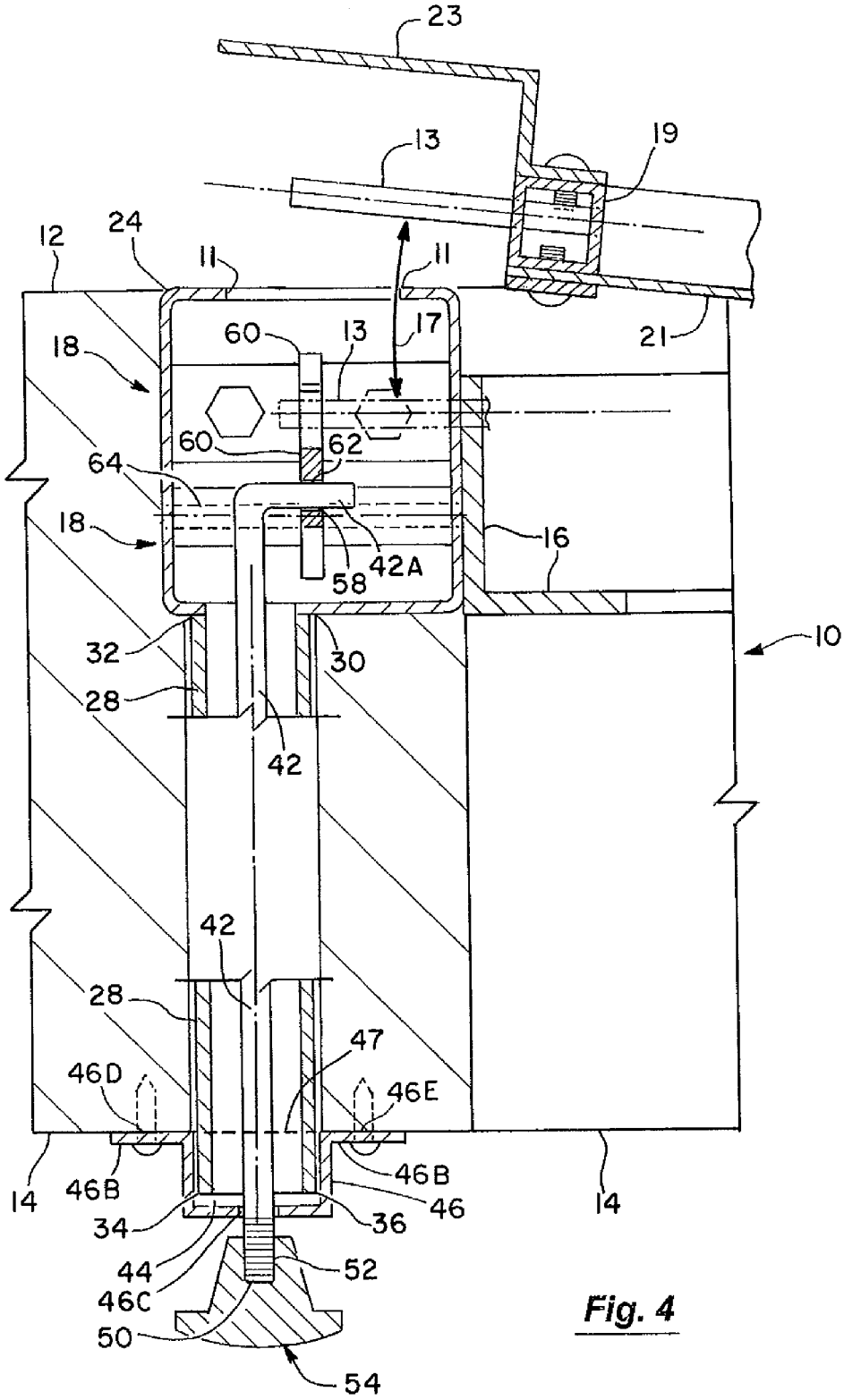
FIG. 4 is also a cross sectional view of the free egress latch shown with the window sash and its associated latch pin disengaged from the free egress latch system.

FIG. 4 is also a cross sectional view of the free egress latch system 10 wherein the window latch pin 13 is shown completely free of the latch cam 60 as the window is being opened. This view also better illustrates the placement of, and function of, the anti-tampering plate. In effect, the anti-tampering plate 23 covers the opening 11 in the 24-26 side of the housing 18. This anti-tampering plate 23 serves to thwart a would-be burglar from gaining access to the interior of the latch housing and, hence, the locking mechanism contained therein.

FIG. 5 depicts the B-B cross sectional view suggested in FIG. 2. It illustrates that the latch cam 60 contains a hole 62 in which the axle 64 resides. The hole 62 in which the axle resides is depicted as being located in a more or less central region 65 of the latch cam 60 which, by way of example, is shown as having a generally crescent shaped body. Again, the axle 64 is stationary by virtue of its ends being affixed (e.g., by welding, threading) to opposing walls of the rectangular housing component 18 in the manner generally illustrated in FIG. 8. As previously noted, the diameter of the axle 64 is smaller than the diameter of the hole 62 in the latch cam 60. Thus, the latch cam 60 is capable of a rocking motion (generally depicted by curved, two-headed arrow 61) about the axle 64 under a force 56 delivered from the push knob 54 to the latch cam 60 via the push rod 42 whose L-shaped end 42A resides in a second hole 58 in the lower end of said latch cam 60. In effect, FIG. 5 shows the latch cam 60 in a first operating position wherein no force 56 is being applied to the push rod 42 from the push knob 54. In this first operating position the latch pin 13 resides in a concave inner cam region 68 of the latch cam 60. This concave inner cam region 68 may also be referred to as a "first surface" in this patent disclosure and/or its claims. Be that as it may, a "nesting" of the latch pin 13 in this concave inner cam region 68 serves to hold the window sash 19 depicted in FIGS. 1 and 3 in its closed, locked mode. FIG. 5 also illustrates how the inner cam region 68 leads to an outer cammed surface 70 over which the latch pin 13 will slide (e.g., in the manner suggested in FIG. 6) as the latch cam 60 is forced to a second operating position illustrated in FIG. 6.

FIG. 5 also illustrates that the interior of the housing 18 also contains a post 72 about which a coil spring 74 is positioned. As will be seen in FIG. 8, there are in fact two such posts 72A and 72B and two such springs 74A and 74B. In any case, the post 72 of this FIG. 5 is shown affixed to a shaft anchor plate 76 whose ends are, in turn, affixed to opposing walls of the rectangular housing 18 in the manner depicted in FIG. 8. In an alternative embodiment of this invention, the anchoring plate 76 can be removed and the bolt end 79 can be attached (by welding, threading, etc.) to the inside surface 83 of the 20-26 side of the housing 18. The post 72 can be readily created by use of a machine bolt whose head is depicted as item 80. The opposite end 79 of the bolt post 72 is shown passing through the anchor plate 76. Next, it should be noted that a moveable cam pressure plate 78 is mounted between the bolt head 80 and the end 77 of the spring 74. The cam pressure plate 78 has a hole 81 through which the bolt post 72 passes. In the first operating position depicted in FIG. 5, the spring 74 is at its fully extended position such that the cam receiver plate 78 is positioned at a level 82 that is commensurate with the fully extended position of the spring 74. In this position the left side 73 of the latch cam 60 comes into abutting contact with a stop 66. This left side 73 generally presents a flat surface rather than a cammed surface. In this first operating position the coil spring 74 is biasing the latch cam 60 in a clockwise direction 75. Hence the push rod 42 is biased in the leftward direction suggested by direction arrow 57. Section lines 8-8 create the view seen in FIG. 8 of this patent disclosure.

Figure 5A:
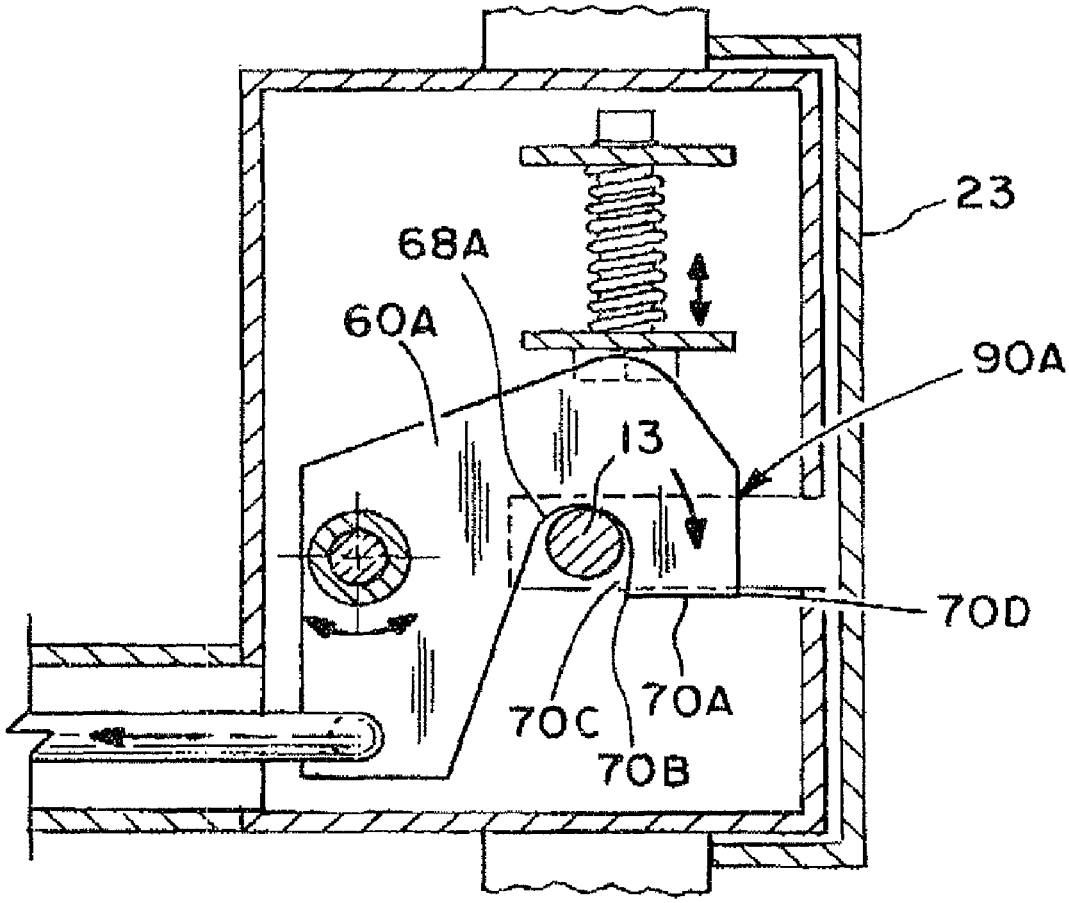
FIG. 5A is a cross sectional view of an alternative embodiment of this invention wherein the cam has a different configuration from the cam depicted in FIG. 5.

FIG. 5A depicts an alternative embodiment of this invention wherein the shape and mounting position of the latch cam 60A differ somewhat from the shape and positioning of the latch cam 60 shown in FIG. 5. For example, in FIG. 5, the inner cam region 68 leads to an outer cammed (i.e., curved) surface over which the latch pin 13 will slide (e.g., in the manner generally suggested in FIG. 6) as the latch cam 60 is forced to a second operating position illustrated in FIG. 6. By way of contrast, in FIG. 5A, the outer cammed (i.e., curved) surface 70 of FIG. 5 has been changed to the generally flat surface 70A depicted in FIG. 5A. Thus, as the latch pin 13 exits the concave inner cam region 68A of the latch cam 60A, it will have to get past the more or less rectangular corner 70B formed by the generally flat (e.g., depicted as being horizontal in FIG. 5A) surface 70A and a generally vertical inside surface 70C of the concave inner cam region 68A of the latch cam 60A. Thus, the transition of the latch pin 13 out of the concave inner cam region 68A and over the generally flat surface 70A will have a certain "go/no go" or "discontinuous" quality to it—as opposed to a smoother, more continuous, transition quality such as that produced by the design by cam 60 of FIG. 5 wherein the latch pin 13 slides over a generally curved surface 70. Next it might be noted that the latch pin blocking surface (depicted as item 90 in FIG. 7) has a somewhat cammed surface. In FIG. 5A, however, it should be noted that the latch pin blocking surface 90A is depicted as being more or less flat and vertical and thereby, in conjunction with the more or less horizontal surface 70A, forming a substantially rectangular corner 70D.

Figure 7:
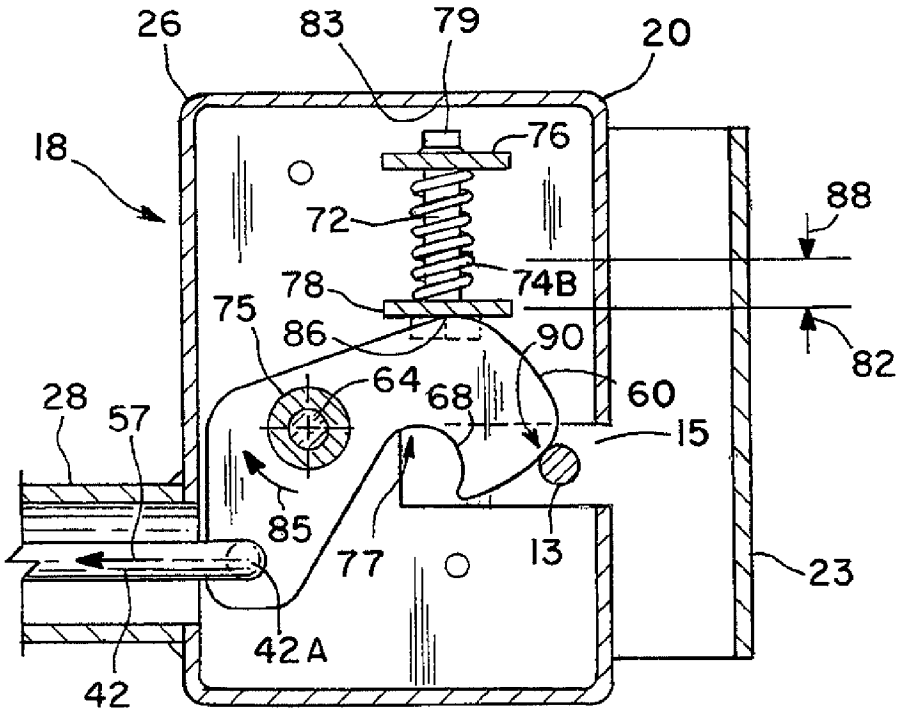
FIG. 7 is a cross sectional side view of the free egress latch in a position such that it is blocking the window latch pin from inadvertently re-engaging with the latch pin locking region of the latch cam.
Figure 7A:
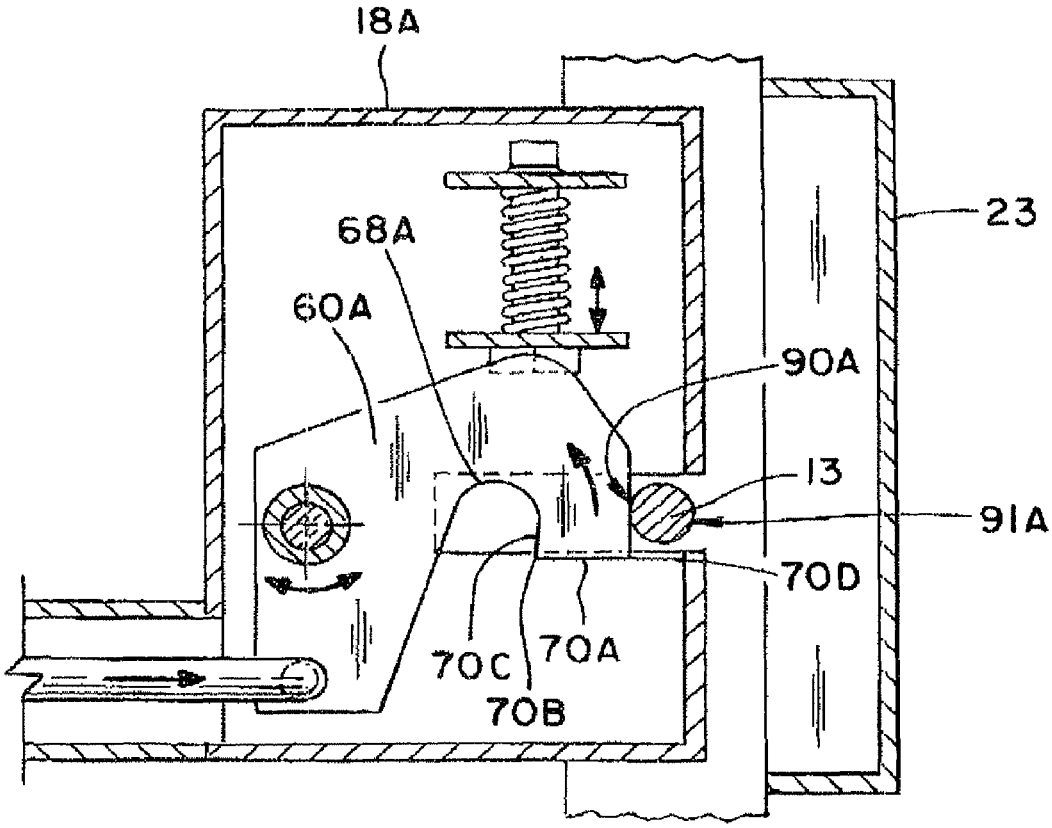
FIG. 7A is a cross sectional side view of the alternative embodiment of FIG. 5A performing its latch pin blocking function.

In a somewhat similar manner, in FIG. 7A, the return of the latch pin 13 from outside of the housing component 18A (as generally suggested by direction arrow 91A of FIG. 7A) will have a certain "go/no go" quality as the latch pin 13 moves past the abutting cam surface 90A in order to reach a threshold level sufficient to slide past the more or less rectangular corner 70D of the latch cam 60A. The presence of the flat, vertical surface 90A may be employed to hold the subject window 21/window sash 19/anti-tampering plate 23 in a more distinctly defined and/or visible (visible from the outside of the building) open position. It might also be noted that using a cam 60A having the configuration generally depicted in FIG. 5A emphasizes the need to push in the push knob 54 (from inside the building) in order to return the latch pin 13 to the concave inner cam region 68A of the latch cam 60A illustrated in FIG. 5A.

Figure 6:
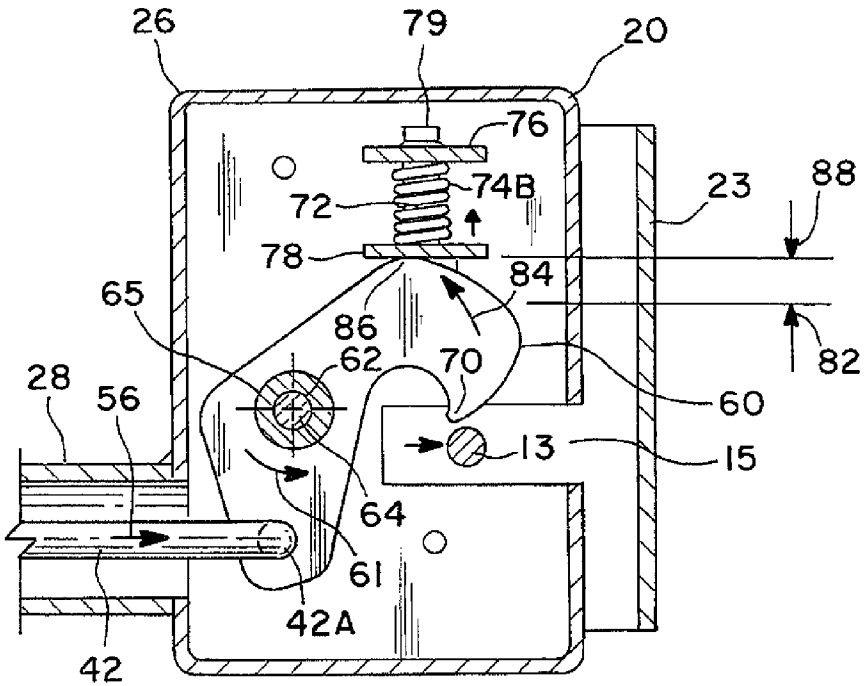
FIG. 6 is a cross sectional view of the free egress latch as the latch pin of the window sash is being disengaged from the latch cam component of the free egress latch system.

FIG. 6 depicts the latch cam 60 in its second operating position wherein an outwardly directed force 56 such as that depicted in FIG. 3 is being applied to the push rod 42 from a force 56 placed upon the push knob 54. This force 56 is placed upon the L-shaped end 42A of the push rod 42 and thereby causing the latch cam 60 to rotate about the axle 64 in the counterclockwise direction suggested by direction arrow 84. This counterclockwise rotation 84 of the latch cam 60 allows the latch pin 13 to slide past the outer cammed surface 70 and on through the slot 15 (that is located in the 20-26 side of the housing 18) and the opening 11 (that is located in the 24-26 side of the housing) in the housing 18 and thereby allowing the window sash 19 in which the latch pin 13 is mounted to proceed to an open position such as that depicted in FIGS. 1 and 4. This latch cam rotation 84 also causes a top cammed surface 86 of the latch cam 60 to be forced against the cam pressure plate 78 and thereby compressing the spring 74 between the anchoring plate 76 and the cam pressure plate 78. A continued application of the force 56 will drive the top cammed surface 86 of the latch cam 60 to its highest position which is generally depicted by level 88 of the cam pressure plate 78.

FIG. 7 shows a side cut away view of the housing 18 in which the latch cam 60 is in a third operating position wherein the outwardly directed force 56 applied to the push knob 54 has been removed. Under this condition the spring 74 (under its own expansive motive force) will return to its fully expanded position. This will cause the cam pressure plate 78 to return from its compressed spring position 88 to its extended spring position 82. This spring expansion will cause the latch cam 60 to rotate in the clockwise direction depicted by direction arrow 85. This, in turn, will force the push rod 42 in the inwardly directed direction suggested by direction arrow 57. There is however an important distinction between the third operating position and the first operating position depicted in FIG. 5, to wit: the latch pin 13 is not nested in the inner cammed surface 68 of the latch cam 60 (as it is in FIG. 5), but rather is seen abutting against an outer cam surface 90 of the right side of latch cam 60. This latch pin 13/outer latch pin blocking surface 90 abutting arrangement constitutes an important safety feature of this free egress latch system 10. It serves to prevent (especially under the stress of emergency conditions such as a fire) an inadvertent relocking of the window sash 19 (i.e., return of the latch pin 13 to the inner cam region 68 as depicted in FIG. 5) and thereby preventing re-access to the room wherein the window is located. In effect, the latch pin 13 abutment against latch pin blocking surface 90 of the latch cam 60 can only be overridden by again pressing the push knob 54 inward from inside the room where the push knob 54 is located.

FIG. 7A depicts the situation wherein the alternative embodiment of this invention shown in FIG. 5A is shown in its latch pin blocking mode. That is to say that the latch pin 13 is shown abutting against a latch pin blocking surface 90A that is not curved in the manner of the curved surface 90 of FIG. 5, but rather is flat in nature. In effect, this latch pin blocking surface 90A presents a flat, vertical surface that is normal to the return direction line 91A the latch pin 13 would follow if the window to which said latch pin 13 is attached were being forced inward (i.e., following direction line 91 A).

Figure 8:
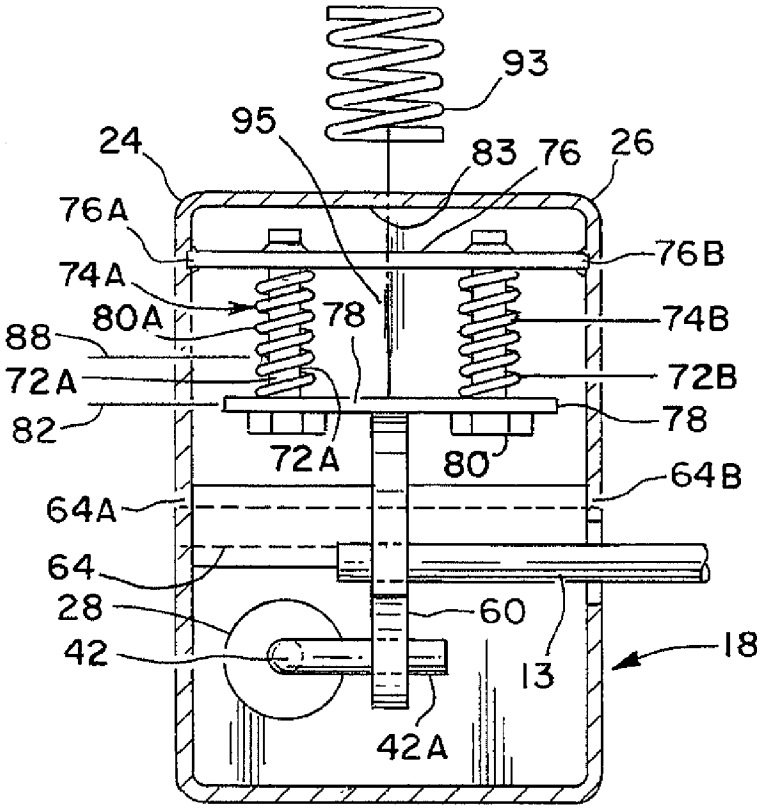
FIG. 8 is a cross sectional side view of the free egress latch that depicts the cam in pressured contact with a spring biased pressure plate.
Figure 9:
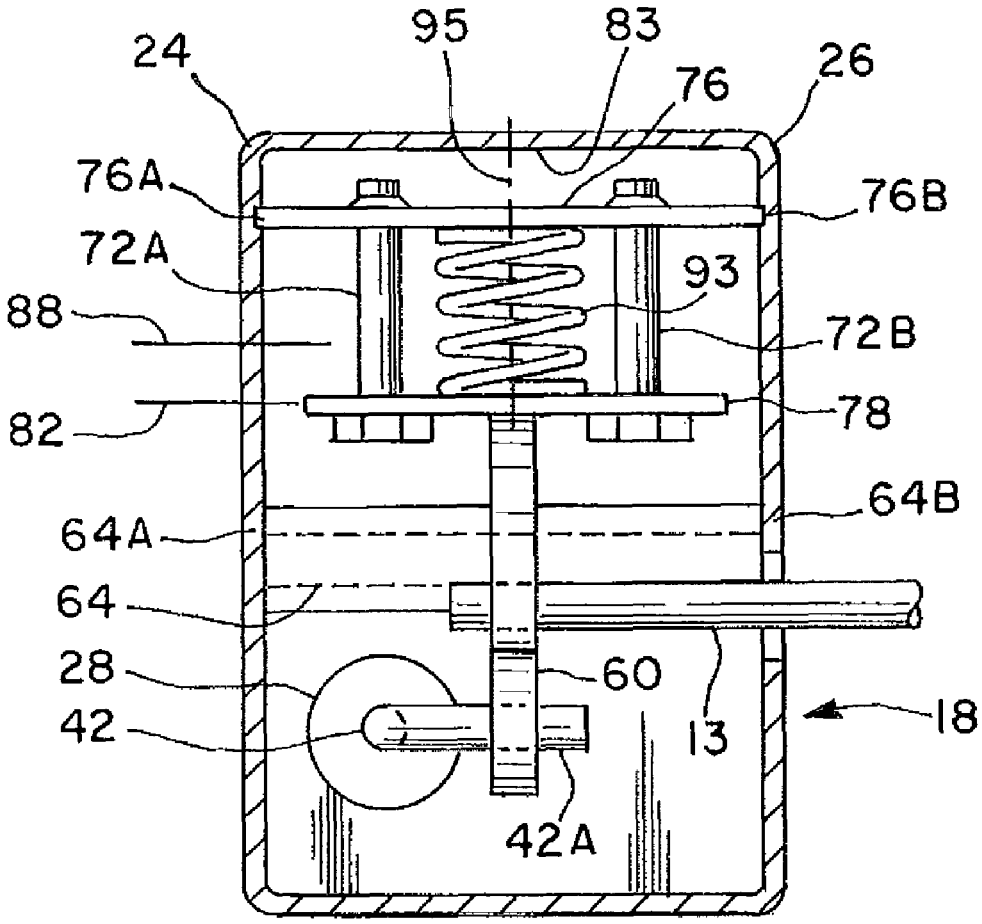
FIG. 9 is a cross sectional side view of the free egress latch that depicts the cam in pressured contact with a pressure plate that is biased by a centrally located single coil spring.

FIG. 8 is an end view of the rectangular housing 18 as seen from side 24-26. This FIG. 8 depicts the cam plate 78 at a level 82 that comports with the extended state of the spring 74 in FIG. 5 (and FIG. 7). This figure also illustrates how the ends 76A and 76B of the anchor plate 76 can be affixed (e.g., by welding) to the walls of the rectangular housing component 18. Similarly, the ends of the axle 64 can be affixed to said walls of the housing component 18. FIG. 8 also suggests an alternative pressure plate biasing device that could take the form of a single spring 93 that could be placed in a central location 95 in the interior of the housing 18. The respective ends of the spring 93 would reside between the anchor plate 76 and the pressure plate 78. In effect, such a spring 93 would replace the springs 74A and 74B to create a mechanical construct wherein the pressure plate 78 is placed at a level 82 by biasing action of a centrally located single coil spring such as the coil spring 93 shown in FIG. 9. It too would compress and decompress between opening positions 88 and 82. In another embodiment of this invention the anchoring plate 76 can be removed and the bottom end of the single spring pressured against the inside surface 83 of the 20-26 side of the housing 18. Similarly, the anchoring plate 76 could be removed and the two posts 72A and 72B anchored to the inside surface 83 of the 24-26 side of the housing 18.

Finally, it also should be appreciated that the same basic components of Applicant's free egress latch system can be used for a wide range of windows, skylights (and even doors). Moreover various field changes may be required for window, skylight or door systems of different profile or materials, and that such field changes should also to be considered to be within the scope of the claims of this patent disclosure.

Thus having disclosed this invention, what is claimed is:

1. A latch system comprising:

a housing having a slot that allows passage of a latch pin into/out of an interior of said housing and a hole that allows passage of a push rod into/out of said interior;

a latch cam capable of clockwise/counterclockwise motion about an axle upon which said latch cam is rotatably mounted and wherein said latch cam is further provided with:

(i) a first hole through which the axle passes;

(ii) a top camming surface for pressing against a cam pressure plate;

(iii) a concave inner cam region for receiving the latch pin;

(iv) a latch pin blocking surface and wherein the latch pin has an engaged and disengaged position with respect to the concave inner cam region of the latch cam and wherein a cam pressure plate is biased against the top camming surface of the latch cam so that when the latch pin exits the housing and is disengaged from the inner cam region, the latch cam rotates under the bias of the top camming surface so that the latch pin blocking surface prevents the latch pin from returning to the engaged position; and (v) a second hole in which a push rod end is mounted;

and wherein (a) said axle is mounted in the interior of the housing and has a diameter smaller than the diameter of the first hole in the latch cam through which the axle passes and thereby allowing clockwise/counterclockwise motion of the latch cam about the axle, (b)

said cam pressure plate is biased against the top camming surface of the latch cam by a biasing device that pressures the cam pressure plate against the latch cam and (c)

a tubular sleeve is affixed to the housing and contains a push rod whose inner end is connected to the second hole in the latch cam and whose outer end is connected to a push knob adapted and arranged to receive pressure in order to force the push rod toward the housing and thereby rotate the latch cam about the axle and release the latch pin from the concave inner cam region of the latch cam.

2. The latch system of claim 1 wherein the latch pin blocking surface is curved.

3. The latch system of claim 1 wherein the latch pin blocking surface is flat.

4. The latch system of claim 1 wherein the latch pin is associated with a window.

5. The latch system of claim 1 wherein the latch pin is associated with a skylight.

6. The latch system of claim 1 wherein the latch pin is associated with a door.

7. The latch system of claim 1 wherein an escutcheon is positioned between the push knob and an inner wall of a building through which the push rod protrudes.

8. The latch system of claim 1 wherein the cam pressure plate is biased against the latch cam by two springs respectively mounted about two posts that are anchored to an anchor plate.

9. The latch system of claim 1 wherein the cam pressure plate is biased against the latch cam by two springs respectively mounted about two posts that are anchored to an inside surface of a housing side.

* * * * *